United States Patent [19]

Fock et al.

[11] 4,156,038

[45] May 22, 1979

[54] PROCESS FOR PRODUCING A FINISH-EFFECT FILM HAVING PORES OR STRUCTURES THAT CORRESPOND WITH THE PRINTED AREA

[75] Inventors: Jürgen Fock, Düsseldorf; Helmut Bühler, Essen; Manfred Schmuck, Essen; Alfred Walter, Essen, all of Fed. Rep. of Germany

[73] Assignee: Th. Goldschmidt AG, Essen, Fed. Rep. of Germany

[21] Appl. No.: 763,100

[22] Filed: Jan. 27, 1977

[30] Foreign Application Priority Data

Feb. 7, 1976 [DE] Fed. Rep. of Germany ..... 2604915

[51] Int. Cl.[2] ..... B05D 5/00

[52] U.S. Cl. ..... 427/210; 427/259; 427/262; 427/264; 427/265; 428/165; 428/211

[58] Field of Search ..... 427/303, 308, 257, 262, 427/264, 259, 411, 210, 265; 428/153, 211, 453, 165; 162/137

[56] References Cited

U.S. PATENT DOCUMENTS

| | | | |
|---|---|---|---|
| 1,365,716 | 1/1921 | Morrison | 428/453 |
| 2,422,423 | 6/1947 | Kvalnes | 427/439 X |
| 3,607,348 | 9/1971 | Wray et al. | 428/211 X |

*Primary Examiner*—Ronald H. Smith
*Assistant Examiner*—Evan K. Lawrence
*Attorney, Agent, or Firm*—Toren, McGeady and Stanger

[57] ABSTRACT

A method for making a finish-effect film which possesses pores in a predetermined design pattern by printing an absorbent water-swellable supporting web in a predetermined design pattern with a substance that retards penetration of water, coating the web with an aqueous resin preparation, and then curing the resin. Three-dimensional pores are produced in the web in a pattern corresponding to the predetermined design due to greater swelling of the unprinted areas of the web by impregnation of the water from the aqueous resin preparation as compared to the printed areas. The thus produced finish-effect film can be used for decorative purposes in a manner similar to wood veneers.

12 Claims, No Drawings

PROCESS FOR PRODUCING A FINISH-EFFECT FILM HAVING PORES OR STRUCTURES THAT CORRESPOND WITH THE PRINTED AREA

BACKGROUND OF THE INVENTION

1. Field of the Invention

The invention relates to a process for producing a so-called "finish-effect film" having three-dimensional pores or structures that correspond to the printed area.

2. Description of the Prior Art

Finish-effect films are supporting webs, e.g., of paper, which are printed with a design, especially a wood design, and are impregnated or coated with a resin, and in which the resin is cured without pressure. These finish-effect films are then glued like wood veneers onto the surface of wood-based materials under the action of a slight pressure of ca. 5 kg/cm$^2$. The gluing may also take place at a higher pressure by means of a resin or additional film, which serves as an adhesive and is situated on the reverse side of the finish-effect film.

In finish-effect films with a wood design, for example, it was customary until now to impress the pores by means of an embossing calender into the resin which is in a state such that it is no longer or practically non-flowable. The disadvantage of this process lies in the need to exert a mechanical stress on the web and especially in the fact that the surface structure and and the printed area do not generally coincide since, for economic reasons, it is not possible to hold the appropriate calender roll in readiness for each printed area or to carry out the calendering so as to correspond with the printing. It is an additional disadvantage that a special operating step is required for the calendering.

In recent times, various attempts have been made to produce structured films that do not have these disadvantages.

Accordingly, a process is already known from German Pat. No. 1,942,780, in which the paper is provided with a polymerization inhibitor for the coating resin at those sites at which it is to exhibit pores. This can take place by means of a printing procedure.

On subjecting the polymerization resin to curing conditions, the curing of the resin is prevented or retarded at these sites so that the unhardened polymerization resin which is still liquid can flow away either laterally or into the background to create a deficiency of cured resin on the surface at those sites where the inhibitor was present to thereby form an artificial pore.

If a polymerization inhibitor is applied by a special printing procedure at those sites of a wood design which are to have pores, pores are obtained which correspond in position with the printed area.

A disadvantage of this process, inter alia, resides in that it is restricted to using polyester resin which must be cured on the paper web by polymerization with monomeric organic compounds, such as, for example, styrene. Some of these monomers are volatile under curing conditions and special precautions must be taken because of the flammability of these volatile components. Also, such monomers are physiologically harmful.

In addition, the process is cumbersome and difficult to carry out in practice, as is evident from a description in the journal "Japan Plastics Industrial Annual," 1975, Page 64. There is a further description of the process in the published Japanese patent application No. 28 262/74. It is particularly disadvantageous in that, that products obtained by using paper according to this process are not resistant to splitting or delamination so that the surface can easily be separated from the substrate by appropriate mechanical stresses.

A chemical embossing process is known from German Auslegeschrift No. 1,277,721, in which a foam inhibitor or retarder is printed according to a design into a foamable plastic layer so that surface regions of different thickness result.

Another process for producing synthetic resin imitation wood grained surfaces is described in U.S. Pat. No. 3,811,915. According to this process, the paper web is initially provided with a coating, which is allowed to dry whereupon it is printed with a printing ink, which causes the pore formation and which contains 0.1 to 3% by weight of a liquid silicone. The supporting web is then coated with a conventional resin coating. In this process, use is made of the effect that the silicone containing printing ink leads to wetting obstructions for the final coating, so that there is a deficiency of resin at those sites in the surface at which the silicon containing dye is present and a pore structure is produced by physical means.

It is a particular disadvantage of this process that the supporting web which is printed with a printing ink containing silicone, must be coated with resin within at most 20 hours since the effect is no longer observed after this time.

SUMMARY OF THE INVENTION

The object of the present invention is to devise a process for producing a finish-effect film having three-dimensional pores or structures that correspond with a printed area in which the above disadvantages are overcome and which meets all of the necessary requirements of such films while avoiding additional processing steps.

This object is accomplished by printing an absorbent water-swellable supporting web, such as paper, in a predetermined design pattern with a substance that retards penetration of water, coating the web with an aqueous resin preparation, and curing the resin whereby after curing of the resin, three-dimensional pores are produced in the web in a pattern corresponding to the predetermined design pattern, due to the differential absorption of the water between the printed and unprinted areas resulting in greater swelling of the unprinted areas of the web by impregnation thereof with the water from the aqueous resin preparation as compared to the printed areas.

DESCRIPTION OF THE PREFERRED EMBODIMENTS

Substances, suitable for being printed on the supporting webs at sites which are to have three-dimensional pores or structures in the finish-effect film, are printing inks, particularly those based on polymerization resins, condensation resins, addition resins and alkali silicates, the latter being especially in the form of water glass solutions.

The expression "aqueous resin preparations" as used herein is defined as preparations in which the resin is contained dispersed or dissolved in water. For this purpose, the polymerization resins are used in the form of a dispersion in which the solids content should amount from about 30 to 60% by weight. As a rule, the condensation resins are used in the form of their aqueous solution and contain about 40 to 60% by weight of solid resin.

Typical polymerization resins which may be used in the present invention are:

polyacrylates, polymethacrylates, chloroprene rubbers, polyvinyl acetates, which if necessary, are partially hydrolyzed, and polyvinyl alcohols;

hardenable polymerization resins, such as, for example, cross-linkable acrylic resins or alkyd resins, have proven themselves to be particularly advantageous. A cross-linkable silicone resin, such as, for example, a silicone resin that is cured at room temperature by the moisture in the air or by UV radiation, is also suitable;

the hardenable polymerization resin can also be formed in situ wherein the acrylate monomers, polyol diacrylate, pentaerythritol diacrylate or pentaerythritol trimethacrylate, which are to be cross-linked with peroxides, are used;

further suitable resins are the condensation resins, such as, for example, the aminoplast resins, which can be cured by the action of theat and addition resins, such as, polyesters or polyacrylates, which have reactive side chains and can be cross-linked, for example, with polyisocyanate or polyglycidyl compounds;

inorganic compounds that are suitable are the alkali silicates, especially in the form of water glass which can be condensed to insoluble products by the action of heat, especially, in the presence of acid;

further suitable compounds are binders based on proteins, such as, casein or zein, binders based on starch, such as, dextrin or methyl cellulose, salts and esters of natural resin acids belonging to the class of diterpene compounds, e.g., colophony esters, which may be modified with phenolic resins, or metal resinates, e.g., Zn or Ca resinate.

These substances form a component of the binder of the printing ink or they are used directly as binders. They cover the supporting web or penetrate into it whereby they may be additionally fixed by curing so as to reduce the absorptive capacity of the supporting web.

The viscosity of the printing inks is adjusted by varying the solids content, so that, on the one hand, the printing inks do not run excessively during printing and the boundary lines of the printed areas do not become blurred and, on the other hand, sufficient printing ink is applied so that a satisfactory printed area results.

As a result of being printed with the above-named substances, the supporting web swells more at sites adjacent to those on which the pores are printed when the aqueous resin preparation is applied so that a change in the thickness of the supporting web occurs. This change in thickness of the supporting web, possibly in combination with a differential destabilization of the aqueous resin preparation, brings about the local formation of pores or structures which correspond to the printed area.

It turns out that the inventive process is carried out most advantageously if the rate of penetration of the aqueous resin preparations at the printed sites is reduced from a half to about a tenth of the value that the supporting web has at those sites that have not been printed. The quotient of penetration rate of printed site to that at sites that have not been printed accordingly is 0.5 to 0.1

The penetration rate can be determined simply by applying a drop of the aqueous resin preparation to the supporting web and measuring the time in seconds that elapses until the water can be observed to have penetrated through the supporting web to the reverse side.

The inventive process differs from the process of U.S. Pat. No. 3,811,915, mentioned hereinabove wherein liquid silicones are used in that the effect in the case of the inventive process is not based primarily on the water-repellant property of the silicone compounds. Rather, it is based on the fact that the destabilization of water removal from the dispersion is made more difficult by preventing the penetration of the liquid phase of the dispersion into the paper, e.g., by consolidating the paper fibers or by closing off the pores of the paper or by means of a cured silicone resin. As a consequence, swelling of the paper is prevented at this site, and, in addition, the dispersion is drained off into those sites of the regions surrounding the desired pores which are more capable of absorbing it.

A further difference is that, in the case of the inventive process, the resin or binder is applied directly to the paper web in order to consolidate the cellulose fibers, whereas in the process of U.S. Pat. No. 3,811,915, the silicone compounds are applied as a component of the printing ink to a base resin layer and there exert their effect on the paper.

If the printing ink contains a pigment, it is important that the pigment content of the printing ink does not exceed the critical pigment volume concentration since, otherwise, a closed barrier layer which prevents penetration of the liquid phase of the dispersion is not obtained.

An especially preferred version of the inventive process is a procedure wherein the aqueous resin preparation is initially applied to the printed upper side of the supporting web and, if necessary, after an intermediate drying, the supporting web is impregnated and, if necessary, coated on the reverse side with an aqueous resin preparation.

By means of such a technique, the supporting web is given the opportunity of swelling before it is impregnated on the reverse side and before it is subsequently possibly coated and the aqueous preparation is concentrated at those sites which later are to have pores. Both effects together then lead to the formation of the desired surface structure in the finished product of the process.

A technique for carrying out the process that is particularly preferred is wherein the printed upper side of the supporting web is coated initially with the aqueous dispersion of a polymerization resin and, if necessary after an intermediate drying, the reverse side of the supporting web is impregnated with the aqueous solution of a condensation resin and coated with this solution or, after an intermediate drying, coated with the dispersion of a polymerization resin. Through being coated on the reverse side, finish-effect films are self-gluing.

The polymerization resins that can be used in the inventive process are the conventional resins that correspond to the state of the art. The resins may be thermoplastic resins having softening temperatures sufficiently high so that in later gluing operations involving the finish-effect film, the pores and surface structures are maintained. Examples of such resins are acrylic resins, vinyl chloride homopolymers or copolymers, polyester resins, alkyd resins, vinyl acetate copolymers and vinyl alcohol copolymers.

Known hardenable polymerization resins can also be used. Examples of such resins are described in the German Pat. Nos. 1,961,452 and 2,212,928.

As condensation resins which essentially are intended to consolidate the interior of the finish-effect film and to cause it to adhere to the substrate, aminoplast resins, especially urea-formaldehyde and/or melamine-formaldehyde condensation resins can be used which are also known from the state of the art. Dispersions of vinyl acetate homopolymers or copolymers can also be employed as resins that facilitate adhesion.

This technique of carrying out the process is the opposite of the conventional method of coating supporting webs with resin. In the conventional methods, the supporting web is impregnated initially and then coated. The present procedure is characterized by the fact that the surface is first of all coated with the dispersion of a potentially hardenable polymerization resin. The dispersion penetrates into the supporting web with a differential rate. The destabilization of the dispersion also occurs more rapidly at those sites on which there has been no printing. On the printed sites, the destabilization is slower so that the dispersion can be adsorbed away from the region of printing. Subsequently, the supporting web is impregnated and possibly coated with condensation resins, e.g., conventional aminoplast resins, such as, melamine-formaldehyde or urea-formaldehyde resins. If the finish-effect is required to have self-adhering properties, the supporting web can also be coated with polymerization resins after it has been impregnated.

Accordingly, the advantage of the inventive process lies especially in that the pore-producing substance is applied in the printing process in the form of a binder for the printing ink or as a part of the binder for the printing ink, i.e., it is applied during the printing operation without requiring an additional operating step. The thus pretreated supporting webs can then be coated and impregnated by known procedures with resins that are conventionally used for this purpose. No change in production is required if finish-effect films with and without surface structure are to be produced consecutively in the same installation. In principle, it is sufficient to select substances which affect the swelling behavior of the supporting webs and which can be used as binders for the printing ink or as additives for these binders. The products of the process can be stressed mechanically and can be stored indefinitely.

The inventive process is explained in greater detail by means of the following examples:

EXAMPLE 1

15 parts by weight of a pigment mixture consisting of
- 5.60 parts by weight of iron oxide yellow
- 0.07 parts by weight of flame soot
- 1.05 parts by weight of titanium dioxide
- 0.98 parts by weight of iron oxide red
- 3.85 parts by weight of chrome yellow are dispersed in a ball mill for a period of 15 minutes in a mixture of 8.25 parts by weight of a binder based on a methoxy-group terminated methylphenylsiloxane resin and 0.25 parts by weight of n-butyl titanate.

On the upper side of a suitable, filled design paper, with an area weight of 80 g/m$^2$, a wood reproduction is printed with a three-color photogravure printing machine. In the first and second printing mechanisms, the structure is printed with a printing ink which, in the later coating operation, does not lead to three-dimensional pores but to a two-dimensional two-color wood design. In the third printing mechanism, a printing cylinder is inserted that prints an area corresponding to the pore structure by using the above-produced printing ink, which forms the concave structures in the later coating operations. The cure of the silicone binder, which is required for the later discrete formation of the pore structure, is accelerated by treatment with steam and subsequent infrared irradiation.

For forming the concave pores, a design paper is used, through which the liquid phase of the coating dispersion penetrates after ca. 180 seconds at the site of the printing with the silicone printing ink and after ca. 20 seconds at the site of printing with the normal printing ink by means of which a two-dimensional area is formed after the coating operation.

The printed design paper is coated with an aqeous acrylate dispersion according to the German Patent No. 2,212,928, using a wire wiper. After a dwell time of ca. 15 seconds during which it is given an interim drying with an infrared emitter, it is impregnated on the reverse side with an aqueous solution of urea resin and subsequently dried to a moisture content of 2.0%. The amount of the acrylic resin applied is 45 g/m$^2$ and that of the urea resin 52 g/m$^2$.

The film obtained shows a three-dimensional reproduction of the printed area of the pores. The depth of the pores, measured with a roughness meter, was 20 to 45$\mu$ and, after pressing onto a chipboard with a liquid urea resin at a temperature of 135° C. and a pressure of 5 kg/cm$^2$ for 60 seconds, 18 to 40$\mu$. After pressing, the film proved to be resistant to splitting or delamination.

EXAMPLE 2

The procedure is identical with that in Example 1 with the exception that, instead of the aqueous acrylate dispersion, an aqueous solution of an urea-formaldehyde condensation product, modified with thiourea and having a DIN cup viscosity (orifice 4 mm) of 30 seconds, is used for the coating and the aqueous solution of a melamine-formaldehyde condensation product is used for the impregnation on the reverse side.

The amount of coating resin applied is 42 g/m$^2$, the amount of impregnating resin 48 g/m$^2$ and the moisture content is 2.9%. The film obtained shows a three-dimensional reproduction of the pore-structure. The depth of the pores, measured with a roughness meter, was 20 to 30$\mu$ and, after the film was pressed onto a chipboard with an aqueous urea-resin solution at a temperature of 135° C. and a pressure of 4 kg/cm$^2$ for 90 seconds, 10 to 20$\mu$. After pressing, the film proved to be resistant to splitting or delamination.

EXAMPLE 3

In a stirred vessel equipped with facilities for heating and cooling, 20 parts by weight of a cornstarch adhesive, 16 parts by weight of water and 32 parts by weight of ethanol, were stirred at 50° C. until the adhesive was completely dissolved. After cooling, 32 parts by weight of ethylene glycol and 6 parts by weight of iron oxide red were stirred into the solution and the pH of the mixture was then adjusted to 6.5 using 5% sodium hydroxide solution. The viscosity of this solution was 33 seconds as measured in a DIN cup with an orifice of 4 mm diameter.

The printing ink obtained is used in place of the printing ink with a silicone base of Example 1. In other respects, the procedure is the same as in Example 1.

The penetration time of the liquid phase of the coating dispersion used is 35 seconds at the site of the dispersion that has been printed with the printing ink given above. The amount of acrylate resin used for the coating is 55 g/m$^2$ and the amount of urea resin used is 54 g/m$^2$.

The film obtained shows a three-dimensional concave reproduction of the printed area of the pores. The depth of the pores, measured with a roughness meter, is 20 to 42$\mu$ and, after the film is pressed onto a chipboard at a temperature of 135° C. and a pressure of 5 kg/cm$^2$, 17 to 38$\mu$. After pressing, the film proved to be resistant to delamination.

EXAMPLE 4

A printing ink was produced that consists of 100 parts by weight of a 50% aqueous solution of a urea-formaldehyde resin with a DIN cup viscosity (4 mm diameter orifice cup) of 20 seconds, 2 parts by weight of ammonium chloroacetate and 5 parts by weight of a pigment preparation of 4 parts by weight of a chrome yellow pigment and 1 part by weight of a hydrogenated colophony ester.

The printing ink obtained is used in place of the printing ink based on silicone as in Example 1 and the procedure of Example 1 was followed with the exception that the printed paper is heated for 60 seconds at 200° C. in order to complete the condensation of the urea resin.

At the place where it is printed with cured pigmented urea resin, the design paper is penetrated in 172 seconds by the liquid phase of the coating dispersion and, at the side where it is printed with the ink by which a two-dimensional printed area is formed after the paper is coated, it is penetrated after 23 seconds.

The printed design paper so obtained is coated, using a wire wiper, with an aqueous dispersion based on a copolymer of vinylidene chloride and vinyl chloride. After a dwell time of ca. 15 seconds, during which it is given an interim drying with an infrared source, the design paper is impregnated on the reverse side with an aqueous urea-resin solution and subsequently dried to a moisture content of 2.5%. The amount of vinylidene chloride/vinyl chloride copolymer applied is 52 g/m$^2$ and the amount of urea resin 75 g/m$^2$.

The film obtained shows a three-dimensional reproduction of the printed area of the pores. The depth of the pores is 15 to 40$\mu$ and, after pressing the film onto a chipboard with a liquid urea resin at a temperature of 135° C. and a pressure of 5 kg/cm$^2$ for 60 seconds, 12 to 25$\mu$. After pressing, the film proved to resistant to delamination.

EXAMPLE 5

A printing ink was prepared by mixing
9 parts by weight of Zn resinate,
9 parts by weight of iron oxide brown,
60 parts by weight of toluene,
12 parts by weight of ethylene glycol acetate, and
2 parts by weight of bentonite
in a ball mill for 15 minutes.

The procedure for printing the pores as described in Example 1 is carried out with the printing ink obtained above for printing pores, the amount of coating resin applied being 49 g/m$^2$, the amount of impregnating resin being 68 g/m$^2$ and the moisture content being 3.6%.

The film obtained showed a three-dimensional reproduction of the printed area of the pores. The depth of the pores was 30 to 48$\mu$ before and 25 to 42$\mu$ after the film was pressed onto a chipboard with an aqueous urea-resin solution at a temperature of 140° C. and a pressure of 5 kg/cm$^2$ for 70 seconds. After the pressing, the film proved to be resistant to delamination.

EXAMPLE 6

Pores were printed on a design paper of an area weight of 80 g/m$^2$ with the printing inks given in the following table and using the procedure described in Example 1. The paper was again coated and impregnated with an aqueous dispersion of an acrylic resin or with an aqueous solution of urea resin. The table shows the pigment content (iron oxide red) of the printing ink binder, the amount of acrylic resin applied, the time that the acrylic resin dispersion thereon requires to penetrate through the design paper when a paper sample with folded sides floats on the dispersion and the depth of the pores after the film is produced and after is is pressed onto a chipboard. The amount of impregnating resin varied between 49 and 53 g/m$^2$. The acrylic resin dispersion penetrated through the unprinted paper in 18 seconds.

| Type of Printing Ink Binder | Pigment Content (Iron Oxide Red) [%] | Amount Applied [g/m$^2$] | Penetration Time [Seconds] | Depth of Pores before pressing $\mu$ | Depth of Pores after pressing $\mu$ |
|---|---|---|---|---|---|
| Acrylate-Acrylamide | 22 | 52 | 45 | 12–25 | 10–22 |
| Copolymer | 22 | 89 | 45 | 20–35 | 15–30 |
| Styrene Acrylic Acid | 19 | 55 | 57 | 12–22 | 10–20 |
| Copolymer | 19 | 85 | 57 | 21–30 | 16–26 |
| Urea-Formaldehyde | — | 49 | 148 | 25–40 | 21–40 |
| Resin | — | 90 | 148 | 35–50 | 30–45 |
| Acrylate-Methacrylate | 24 | 52 | 95 | 20–35 | 18–32 |
| Copolymer-Alkyd Resin | 24 | 91 | 95 | 40–55 | 35–50 |
| Mixture | | | | | |
| Polymethylphenyl- | | | | | |
| Siloxane Containing | 18 | 45 | 120 | 18–24 | 15–22 |
| Acrylic Acid groups | 18 | 85 | 120 | 25–33 | 22–28 |
| (UV Hardened) | | | | | |
| Methoxy-Group | | | | | |
| Terminated Polymethyl- | 20 | 52 | 170 | 35–50 | 30–45 |
| phenylsiloxane | 40 | 51 | 135 | 20–32 | 16–28 |
| (Thermally Hardened) | | | | | |

What is claimed is:

1. In a process for producing a finish-effect film having a three-dimensional surface wherein an absorbent, water-swellable, supporting web is coated with an aqueous resin preparation and the resin is allowed to cure, the improvement which comprises printing the web in a predetermined design pattern with a substance that retards the penetration of the water phase of the aqueous resin preparation into the supporting web prior to coating the web with the resin preparation whereby after curing of the resin, three-dimensional pores are produced in the web in a pattern corresponding to the predetermined design pattern, due to the differential absorption of the water between the printed and unprinted areas resulting in greater swelling of the unprinted areas of the web by impregnation thereof with the water from the aqueous resin preparation as compared to the printed areas.

2. The process of claim 1 wherein the printing substance is a polymerization resin.

3. The process of claim 1 wherein the printing substance is a hardenable polymerization resin and this resin is hardened after printing.

4. The process of claim 1 wherein the printing substance is a condensation resin and this resin is hardened after printing.

5. The process of claim 1 wherein the printing substance is an alkali silicate and the silicate is condensed after printing.

6. The process of claim 1 wherein the aqueous resin preparation is initially applied to the printed upper side of the supporting web and then the reverse side of the supporting web is impregnated with an aqueous resin preparation.

7. The process of claim 6 wherein the reverse side is impregnated with an aqueous solution of a condensation resin.

8. The process of claim 6 wherein the printed upper side of the supporting web is initially coated with an aqueous dispersion of a polymerization resin and the reverse side of the supporting web is impregnated with an aqueous solution of a condensation resin and, after an interim drying, coated with the dispersion of a polymerization resin.

9. The process of claim 6 wherein the web is dried after said initial application of the aqueous resin and prior to impregnating the reverse side of the web.

10. The process of claim 6 wherein the printed upper side of the supporting web is initially coated with an aqueous resin preparation which is a dispersion of a polymerization resin and the reverse side of the supporting web is impregnated with an aqueous resin preparation which is a solution of a condensation resin and coated with the solution.

11. The process of claim 10 wherein after the impregnation, the reverse side is coated with the condensation resin solution.

12. The process of claim 10 wherein after the impregnation, the web is dried and the reverse side is coated with the dispersion of the polymerization resin.

* * * * *